United States Patent [19]

Rüger

[11] Patent Number: 4,984,782

[45] Date of Patent: Jan. 15, 1991

[54] MAGIC CARD

[75] Inventor: Walther Rüger, Munich, Fed. Rep. of Germany

[73] Assignee: Refeka Werbemittel GmbH, Munich, Fed. Rep. of Germany

[21] Appl. No.: 503,984

[22] Filed: Apr. 3, 1990

[30] Foreign Application Priority Data

Apr. 4, 1989 [DE] Fed. Rep. of Germany ... 8904156[U]

[51] Int. Cl.[5] ..... A63T 21/00

[52] U.S. Cl. ..... 272/8 R; 272/8 N

[58] Field of Search ..... 272/8 R, 8 N, 27 R, 272/27 N

[56] References Cited

U.S. PATENT DOCUMENTS 598,537 2/1890 Rosenzweig ..... 272/8 N 2,529,151 11/1950 Glass et al. ..... 272/8 R X

FOREIGN PATENT DOCUMENTS 1052249 11/1983 U.S.S.R. ..... 272/8 R 1360752 12/1987 U.S.S.R. ..... 272/8 R

*Primary Examiner*—Richard E. Chilcot, Jr.

*Attorney, Agent, or Firm*—Venable, Baetjer and Howard

[57] ABSTRACT

The present invention refers to a magic card formed of blanks and provided with a cover and with a slide member, which is guided in said cover and which is adapted to be pulled out of said cover at least partially, said cover having a front wall and a rear wall as well as an insertion opening on one side thereof and said slide member having two slide member surfaces, which are placed one on top of the other and which are interconnected on one side thereof, one of said slide member surfaces being transparent and the other slide member surface constituting a picture area. The present invention solves the task of simplifying the production of such known magic cards. The solution of the task according to the invention is characterized by the features that the cover consists of a single blank, the rear wall and the front wall being folded towards each other about a common folding line and said front wall being provided with a cut by means of which a window as well as a tongue, which is adapted to be slipped between the two slide member surfaces, are formed, said tongue covering the picture area of the slide member and constituting a picture area itself.

18 Claims, 4 Drawing Sheets

MAGIC CARD

BACKGROUND OF THE INVENTION:

The present invention refers to a magic card formed of blanks and provided with a cover and with a slide member, which is guided in said cover and which is adapted to be pulled out of said cover at least partially, said cover having a front wall and a rear wall as well as an insertion opening on one side thereof and said slide member having two slide member surfaces, which are placed one on top of the other and which are interconnected on one side thereof, one of said slide member surfaces being transparent and the other slide member surface constituting a picture area.

Magic cards of a known type are provided with a cover having a picture wall in addition to a front and a rear wall, said picture wall being arranged between the two slide member surfaces and being preferably connected to the rear wall via a folding line extending in a direction longitudinal to the direction of movement of the slide member. The front wall is provided with a window behind which the transparent surface of the slide membe is arranged so that the picture wall, which is arranged between the slide member surfaces, is visible through the window. In said window, pictures can be seen, which are attached to the picture area or/and to the transparent slide member surface. When the slide member is pulled out, a picture can be seen, which is provided on the slide member surface constituting the picture area. A surprising effect can, for example, be achieved when the transparent slide member surface has printed thereon only the outlines of a picture, whereas the picture wall of the slide member shows a coloured full representation of the same picture. When the slide member is being pulled out, it will then look as if the picture of outlines were converted into a coloured picture.

The present invention aims at solving the task of providing a magic card of the type mentioned at the beginning whose production is simplified in comparison with the production of known magic cards.

In accordance with the present invention, this task is solved by the features that the front wall and the rear wall of the cover of said magic card consist of a single blank, said rear wall and said front wall being folded towards each other about a common folding line and said front wall being provided with a cut by means of which a window as well as a tongue, which is adapted to be slipped between the two slide member surfaces, are formed, said tongue covering the picture area of the slide member and constituting a picture area itself.

By means of this solution according to the present invention it is achieved that there is no necessity of providing a special picture card for the cover, and this simplifies the production of the magic card as a whole.

In accordance with one preferred embodiment, the magic card according to the present invention has a rectangular shape and the insertion opening is provided at one of the shorter sides. In particular, the magic card has the size of a visiting card, and, with the exception of the transparent slide member surface which is preferably made of a plastics sheet, it consists of cardboard blanks.

In accordance with a further development of the present invention, the blank is provided with an attachment surface on the side of the front wall located opposite the folding line between the front and the rear wall, said attachment surface being folded towards the front wall and glued onto the rear wall. In particular, said attachment surface is approximately coincident with the front and the rear wall, respectively, and it defines a card base.

In accordance with a further advantageous development of the present invention, the rear wall and the slide member surface, which constitutes a picture area, both have an attachment surface, which is separated by means of a folding line, on one of their shorter sides; said attachment surfaces are folded towards the rear wall and the slide member surface, respectively, and they can be glued onto said rear wall and said slide member surface, respectively. These folded attachment surfaces define a stop means, which prevents the slide member from being fully drawn out of the cover.

Further advantageous possibilities of developing the present invention are disclosed in the subclaims.

BRIEF DESCRIPTION OF THE DRAWINGS:

The present invention will now be further explained and described on the basis of embodiments and on the basis of the drawings enclosed, in which.

Figure 1:
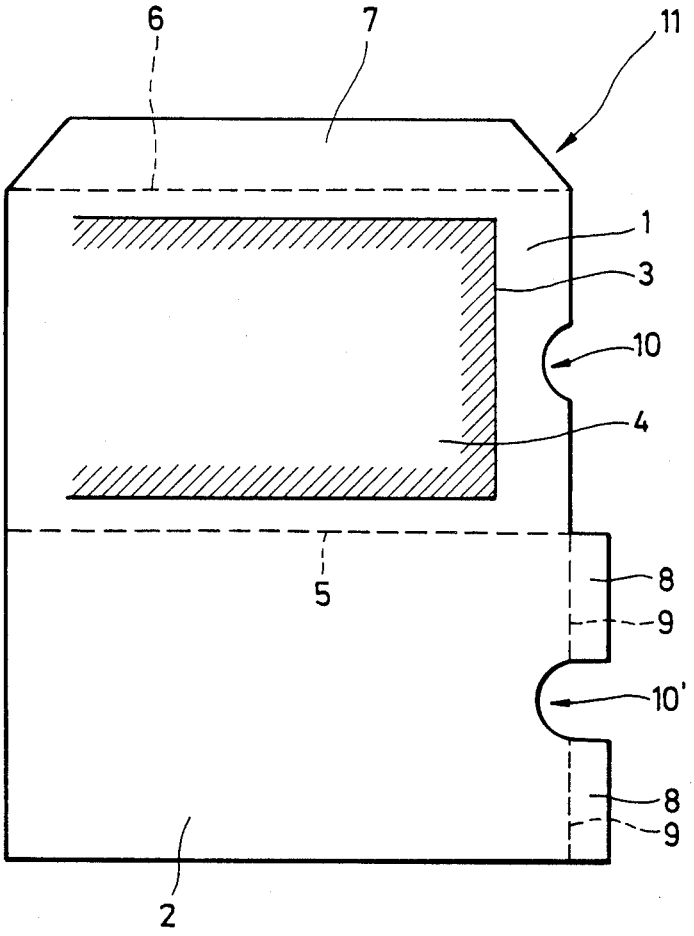
FIG. 1 shows a blank for the cover of a magic card according to the present invention.

DETAILED DESCRIPTION OF THE PREFERRED EMBODIMENTS:

In FIG. 1, reference numeral 11 refers to a blank for a magic card. The blank 11 is provided with a rectangular front wall 1 and with a rectangular rear wall 2. The walls can also have a square shape. The boundary between the rectangular front wall 1 and the rectangular rear wall 2 is defined by a folding line 5. The front wall 1 is provided with a cut 3, which extends along three sides of the rectangle and which defines a tongue 4. On the side located opposite the folding line 5 between the front and the rear wall, an attachment surface 7 is provided on the front wall, the boundary between said attachment surface 7 and said front wall being defined by a folding line 6. One of the shorter sides of the rear wall 2 is provided with an attachment surface 8, which is divided into two subsurfaces, the boundary between said attachment surface 8 and said rear wall being defined by the interrupted folding line 9. Reference numerals 10 and 10', respectively, refer to finger recesses.

Figure 2:
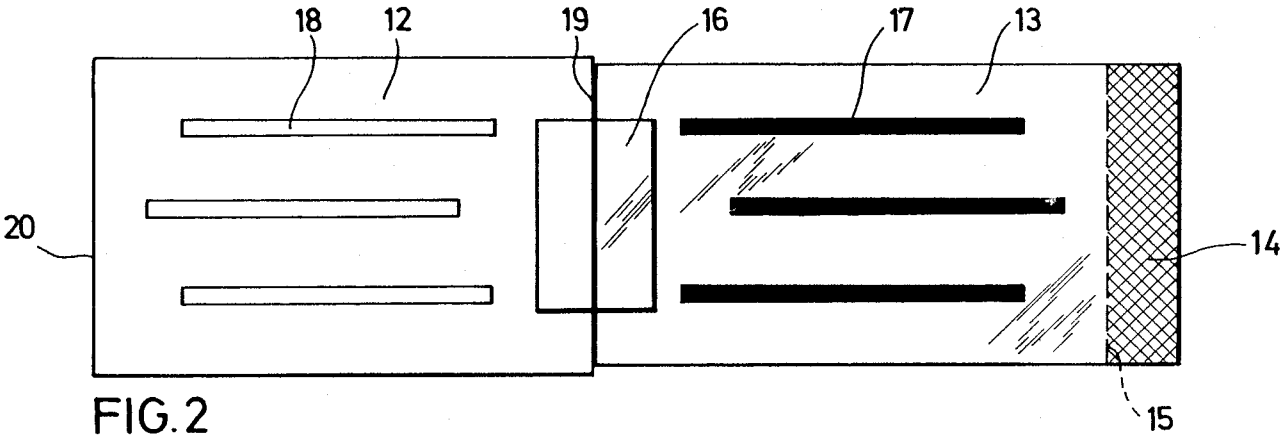
FIG. 2 shows a slide member for a magic card according to the present invention in the open condition.

In FIG. 2, which shows a slide member in the unfolded condition, reference numerals 12 and 13 refer to two slide member surfaces of different widths. The slide member surface 12 having the larger width is transparent and, in the case of the present embodiment, it consists of a plastics sheet. On the other hand, the width of the slide member surface 13 may also be larger than that of the slide member surface 12. The slide member surface 13, which consists of a cardboard blank, is provided with an attachment surface 14, the boundary between said attachement surface 14 and the surface 13 being defined by a folding line 15. The two slide member surfaces 12 and 13 are interconnected by a transparent adhesive film 16, the two opposed edges 19 of the two slide member surfaces bordering directly on each other. It would also be possible to glue the transparent slide member surface on the slide member surface consisting of cardboard and to provide said transparent slide member surface with a folding line extending along the edge 19 of the slide member surface consisting of cardboard. Reference numerals 17 and 18 refer to pictures provided on the slide member surfaces. The picture shown on the transparent slide member surface 12 only consists of the outlines of bars shown on the slide member surface 13. When the slide member surface 12 is folded about an axis along the line 19, the two pictures are brought to coincidence in such a way that it looks as if only one picture existed.

In FIG. 2, reference numeral 20 refers to an edge line 20, which extends in opposed relationship with the edge line 19 and which is part of the transparent slide member surface 12.

Figure 3:
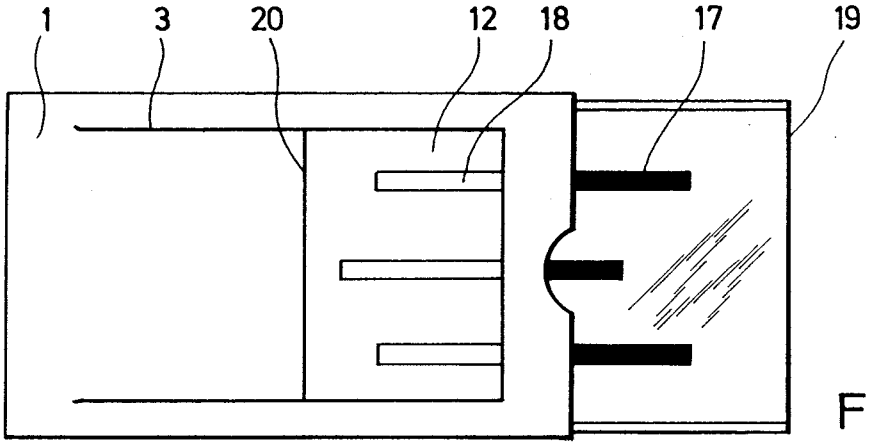
FIG. 3 shows a magic card according to the present invention in the case of which the blank of FIG. 1 and the slide member of FIG. 2 have been used.

For the purpose of producing from the components shown in FIG. 1 and 2 a magic card of the type shown in FIG. 3, the front wall 1 and the rear wall 2 have to be folded towards each other about the folding line 5. Furthermore, the attachment surface 7 has to be folded about the folding line 6, and said attachment surface and the rear wall 2 should preferably be glued together. In the same way, the attachment surface 14 provided on the slide member surface 13 has to be folded about the folding line 15, and, if necessary, said attachment surface and said slide member surface 13 should be glued together. The slide member, which has been folded about an axis along the edges 19, is then pushed into the cover in such a way that the tongue 4 will be positioned in the front wall 1 between the transparent slide member surface 12 provided with the picture of outlines and the slide member surface 13 constituting a picture area. The two ends of the cut 3 form a stop means for the inserted slide member, the edge 20 of the transparent slide member surface 12 being brought into contact with said stop means. The folded attachment surfaces 8 and 14 define a stop means with the aid of which the slide member is prevented from being fully drawn out of the cover.

When the slide member is placed in the cover, only the picture of outlines on the transparent slide member surface 12 is visible. Instead of a picture on the transparent slide member surface 12, it is also possible to apply a picture to the tongue 4. When the slide member is pulled out, a picture can be seen on said slide member, said picture being produced due to the fact that the transparent slide member surface provided with the picture of outlines is positioned on top of the slide member surface 13 constituting a picture area.

Due to the different widths of the two slide member surfaces 12 and 13, it is guaranteed that the outlines on the transparent slide member surface coincide precisely with the edges of the objects on the picture area so that a sharp picture is obtained. In the case of identical widths of the slide member surfaces, a displacement of the two slide member surfaces relative to each other may be caused by tilting of the slide member in the course of the pull-out operation, and this might result in an unsharp picture.

Figure 4:
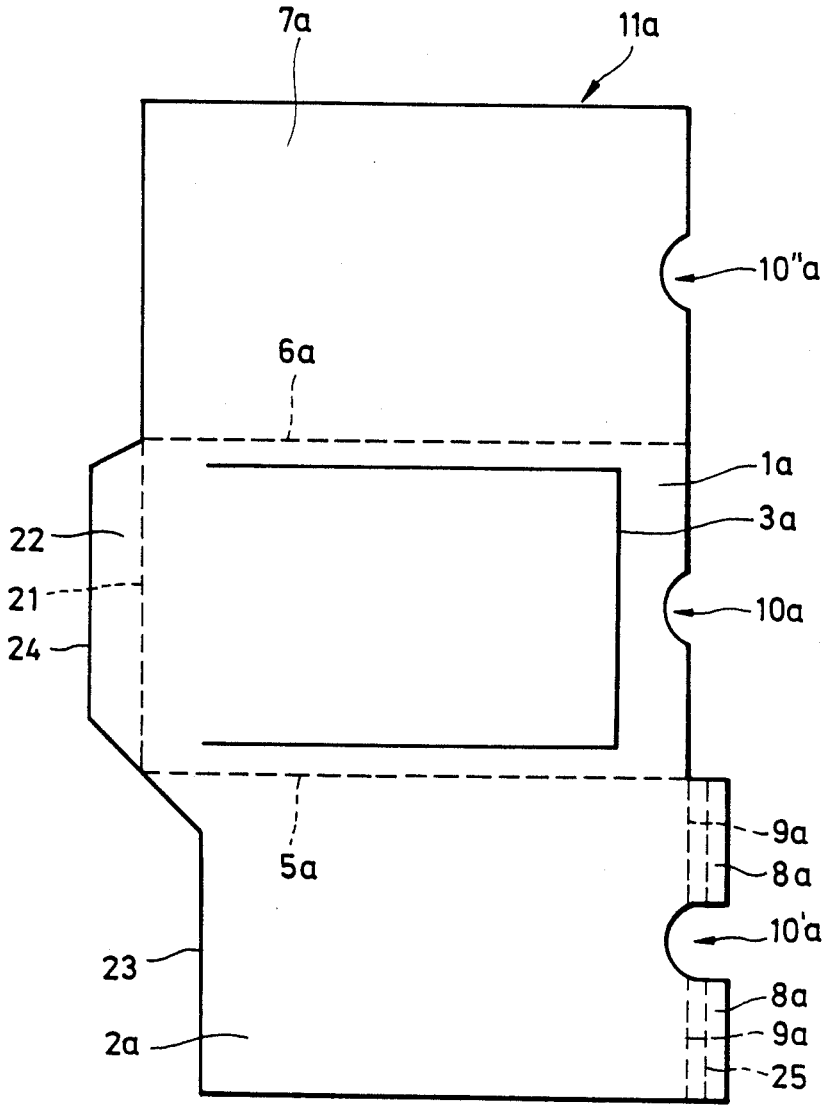
FIG. 4 shows an additional example of a blank for the cover of a magic card according to the present invention.

The embodiment of a blank, which is shown in FIG. 4 and which can be used for producing therefrom a cover for a magic card according to the present invention, differs from the blank shown in FIG. 1 with regard to the fact that the attachment surface 7 is constructed as an attachment surface **7*a*, which coincides with the front or the rear wall. Furthermore, the front wall 1*a* is provided with an attachment surface 22 on the side located opposite the finger recess 10*a*, the boundary between said attachment surface 22 and said front wall la being defined by a folding line 21. Reference numeral 23 contained in FIG. 4 refers to an edge line of the rear wall 2*a*, which is displaced to the rear relative to the folding line 21. The lateral attachment surface 8*a* on the rear wall 2*a* is divided into additional subsurfaces by a folding line 25**.

Figure 5:
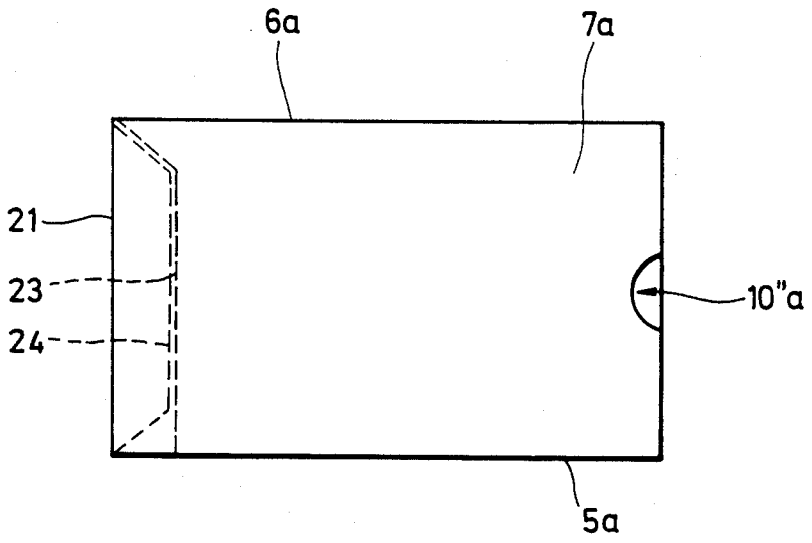
FIG. 5 shows a rear view of the magic card according to the present invention in the case of which the blank for the cover according to FIG. 4 has been used.

The cover produced from the blank **11*a* is shown in FIG. 5 in a rear view. The front wall and the rear wall have been folded towards each other and the attachment surface 22 has been folded round the folding line 21. The attachment surface 7*a*, which defines a card base in the case of the present embodiment, has been folded round the folding line 6*a*, and said attachment surface 7*a*, the rear wall 2*a* as well as the attachment surface 22 are glued together. The edge line 24 of the attachment surface 22 and the edge line 23 of the rear wall 2*a*** border directly on each other.

Due to the folded attachment surface 22, the magic card is laterally closed. The base card, which is coincident with the front and rear walls, respectively, covers in an advantageous manner the slot resulting from the edges 23 and 24 of the attachment surface 22 and of the rear wall **2*a*, which border on each other. Due to the folding of the attachment surface 8*a* about the folding line 9*a* and the folding line 25 a stop means for the slide member is obtained, which prevents—more reliably than in the case of the embodiment according to FIG. 1**—the slide member from being fully drawn out of the cover. A corresponding attachment surface provided with a folding line may also be provided for the slide member.

What is claimed is:

1. A magic card formed of blanks and provided with a cover and with a slide member, which is guided in said cover and which is adapted to be pulled out of said cover at least partially, said cover having a front wall (1) and a rear wall (2) as well as an insertion opening on one side thereof and said slide member having two slide member surfaces (12, 13), which are placed one on top of the other and which are interconnected on one side thereof, one of said slide member surfaces (12) being transparent and the other slide member surface (13) constituting a picture area, characterized in that the cover consists of a single blank (11), said rear wall (2) and said front wall (1) being folded towards each other about a common folding line (5) and said front wall (1) being provided with a cut (3) by means of which a window as well as a tongue (4), which is adapted to be slipped between the two slide member surfaces (12, 13), are formed, said tongue (4) covering the picture area (13) of the slide member and constituting a picture area itself.

2. A magic card according to claim 1, characterized in that the magic card has a rectangular shape and that the insertion opening is provided at one of the shorter sides thereof.

3. A magic card according to claim 2, characterized in that the magic card has the size of a visiting card.

4. A magic card according to claim 1, characterized in that the magic card consists of cardboard blanks (11), and that the transparent slide member surface (12) consists of a plastics sheet.

5. A magic card according to claim 1, characterized in that the blank (11) is provided with an attachment surface (7) on the side of the front wall (1) located opposite the folding line (5) between the front wall (1) and the rear wall (2), said attachment surface (7) being separated by an additional folding line (6) and being adapted to be secured to the rear wall (2).

6. A magic card according to claim 5, characterized in that the attachment surface is a card surface (7*a*), which is essentially coincident with the front wall or the rear wall and which defines a card base.

7. A magic card according to claim 6, characterized in that one of the shorter sides of the front wall (1) is provided with an attachement surface, which is separated by a folding line (21) and which is folded towards the front wall (1).

8. A magic card according to claim 7, characterized in that the rear wall (2), which is folded towards the front wall (1), is provided with a recess, which is located at the point at which the attachment surface folded towards the front wall (1) covers said front wall at the shorter side of said front wall.

9. A magic card according to claim 1, characterized in that one of the shorter sides of the rear wall (2) is provided with an attachment surface (8), which is separated by a folding line (9) and which is folded towards the rear wall (1).

10. A magic card according to claim 9, characterized in that the attachment surface (8), which is folded towards the rear wall (2), and said rear wall (2) are glued together.

11. A magic card according to claim 1, characterized in that the slide member surface (13), which constitutes a picture area, is provided with an attachment surface (14) on one side thereof, said attachment surface (14) being separated by a folding line (15) and folded towards said slide member surface (13).

12. A magic card according to claim 11, characterized in that the attachment surface (14), which is folded towards the slide member surface (13), and said slide member surface (13) are glued together.

13. A magic card according to claim 6, characterized in that the front wall (1), the rear wall (2) and the bottom wall (7) have provided therein aligned finger recesses (10) in the area of the insertion opening.

14. A magic card according to claim 1, characterized in that the two slide member surfaces (12, 13) of the slide member are interconnected by means of an adhesive film (16).

15. A magic ard according to claim 1, characterized in that the two slide member surfaces (12, 13), which are placed one on top of the other, have different widths.

16. A magic card according to claim 15, characterized in that, with regard to their widths, the two slide member surfaces (12, 13) are placed one on top of the other in a symmetrical manner.

17. A magic card according to claim 16, characterized in that the broader slide member surface projects beyond the edges of the narrower slide member surface by approximately 1.5 mm on each side.

18. A magic card according to claim 15, characterized in that the transparent slide member surface (12) is broader than the slide member surface (13) constituting a picture area.

* * * * *